US005845701A

United States Patent [19]

Ruppel et al.

[11] Patent Number: 5,845,701

[45] Date of Patent: Dec. 8, 1998

[54] FIN-TUBE BLOCK FOR A HEAT EXCHANGER AND METHOD OF MAKING SAME

[75] Inventors: Wolfgang Ruppel, Bad Wildbad; Günther Schmalzried, Korb; Rolf Sieber, Mühlacker, all of Germany

[73] Assignee: Behr Industrietechnik GmbH & Co., Stuttgart, Germany

[21] Appl. No.: 955,153

[22] Filed: Oct. 21, 1997

[30] Foreign Application Priority Data

Oct. 26, 1996 [DE] Germany ..... 196 44 584.1

[51] Int. Cl.[6] ..... F28D 1/053

[52] U.S. Cl. ..... 165/81; 165/149; 165/153

[58] Field of Search ..... 165/149, 152, 165/153, 81

[56] References Cited

U.S. PATENT DOCUMENTS

| | | | |
|---|---|---|---|
| 2,063,757 | 12/1936 | Saunders | 165/153 |
| 3,982,587 | 9/1976 | Tramontini | 165/149 |
| 4,936,379 | 6/1990 | Hoshino et al. . | |
| 5,671,806 | 9/1997 | Schmalzried | 165/81 |

FOREIGN PATENT DOCUMENTS

| | | | |
|---|---|---|---|
| 2342787 | 3/1975 | Germany . | |
| 221787 | 8/1994 | Japan | 165/152 |

*Primary Examiner*—Leonard R. Leo
*Attorney, Agent, or Firm*—Evenson McKeown Edwards & Lenahan, PLLC

[57] ABSTRACT

A fin-tube block for a heat exchanger and method of making same are disclosed. The thermal stress on fin-tube blocks of charge air coolers is considerable in the vicinity of the side parts, which can be attributed among other things to the rapid heating of the fin-shaped corrugated ribs and the comparatively slow warming of the side parts. The outermost corrugated rib layer abutting the side parts, opposite to the charge air flow, is displaced forward over the intake edge of the fin-tube block into the intake area for the charge air formed in the side parts and water tanks. In this way, more rapid heating of the side parts can be achieved.

10 Claims, 2 Drawing Sheets

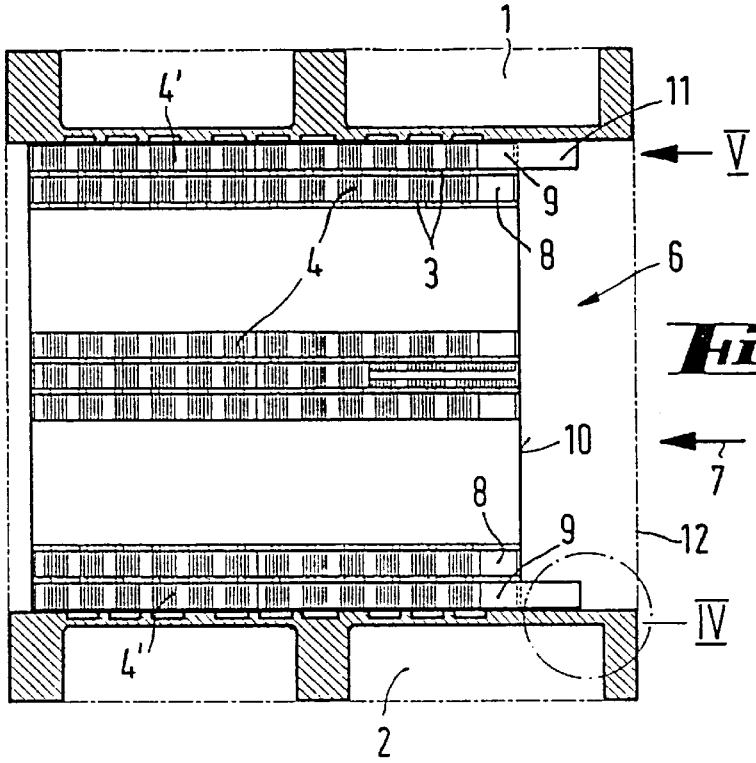
Fig. 3
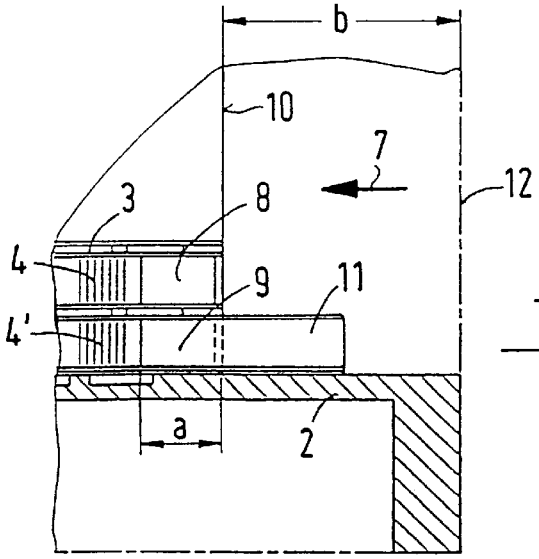
Fig. 4
Fig. 5
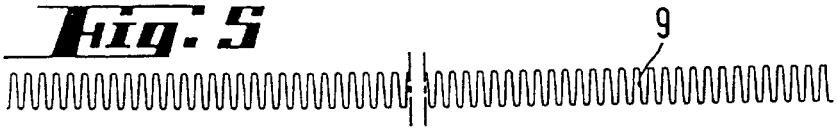
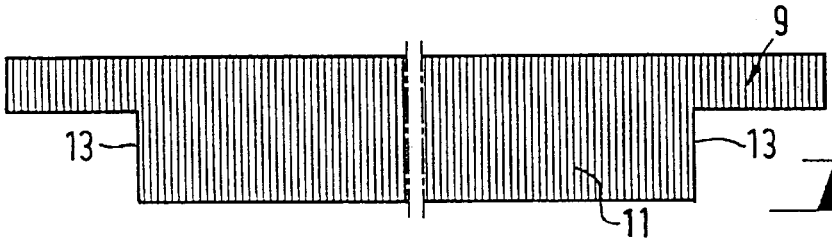
Fig. 6

FIN-TUBE BLOCK FOR A HEAT EXCHANGER AND METHOD OF MAKING SAME

BACKGROUND AND SUMMARY OF THE INVENTION

This application claims the priority of German application 196 44 584.1 filed in Germany of Oct. 26, 1996, the disclosure of which is expressly incorporated by reference herein.

The invention relates to a fin-tube block for a heat exchanger, especially for a charge air cooler, having tubes running parallel to one another and with fin-shaped corrugated ribs located between the tubes, the cooler further being mounted in a fixed frame composed of two water tanks that surround the open tube ends and of two side parts connecting the tanks.

Fin-tube blocks used for charge air coolers are subjected to high alternating thermal stresses. It is known that in charge air coolers used in large engines with power levels of approximately 2000 kW or for high-powered engines for commercial vehicles, temperatures of 235° C. develop at the intake for the boost air when such engines are accelerated to full load. If the cooling water temperature is approximately 40° to 50° when alternating loads occur, especially when accelerating to full power or conversely when reducing the power to idle, the rapid temperature increase in the boost air causes problems with the strength of the heat exchanger. In addition, formation of vapor bubbles in the tubes must also be avoided. For this purpose, it has been taught (German Patent Document DE-OS 23 42 787) to remove the corrugated ribs in the first row of tubes or to provide thermal insulation so that the heating in the first rows of tubes is not so intense. Heat exchangers of such design however are very expensive. In such heat exchangers, there is nothing to prevent the corrugated ribs themselves from expanding suddenly on the air intake side when the charge air temperature, as described above, increases from 50° to 135° C. within a few seconds for example. The thermal expansion then causes the outer corrugated ribs on the side parts to kink and as a result, with continuously repeated temperature changes, cracks can occur that cause damage to the charge air cooler.

An object of the invention is to avoid these harmful phenomena as much as possible.

Taking its departure from the fact that it is advantageous for this purpose if, except for the corrugated ribs that belong to the fin-tube block, the side parts adjacent to these ribs are heated at least in the area where the charge air enters, in a fin-tube block of the species recited at the outset, the invention provides that the outermost corrugated ribs that abut the side parts are moved forward in the through-flow direction of the charge air further in the direction of the intake cross section for the charge air. By virtue of this measure, the corrugated ribs that are heated very rapidly by their contact with the charge air also give off heat to the side parts in the air intake area by thermal contact, so that these parts, at least in this area, expand similarly to the corrugated ribs and a certain degree of compensation is achieved for the expansion movements of the fin-tube block in the air intake area.

In an improvement of the invention, the outermost corrugated ribs in the intake area can each be formed by a corrugated rib strip that is advanced forward, said strip extending the corrugated ribs abutting the side parts toward the intake area. This design is relatively simple to manufacture and does not necessitate any change in the design of the resultant fin-tube block.

According to an advantageous feature of preferred embodiments of the invention, the corrugated rib strips can have different depths in the flow direction of the air and can be provided with recesses in the vicinity of the water tanks. It has been found that it is advantageous for manufacturing reasons for this corrugated strip that abuts the side parts not to extend completely up to the water tanks because in this area welded seams must be produced later during manufacture that could damage the corrugated ribs.

According to an advantageous feature of preferred embodiments of the invention, the outermost corrugated rib strip with the area that extends over its complete width can extend up to a depth in the corrugated rib arrangement up to which all of the other corrugated ribs are formed of corrugated rib strips that consist of a material with a thermal conductivity that is low by comparison with the other corrugated ribs. In a previous commonly assigned U.S. application Ser. No. 08/649,236 filed May 17, 1997, and corresponding to German application 195 19 633.3, as U.S. Pat. No. 5,671,806, not published previously, a corrugated rib design of this kind has already been proposed in order thus to reduce the expansion of the corrugated ribs in the air intake area. Such a fin-tube block design can also be utilized in simple fashion for implementing the design according to the invention. Of course, it is also contemplated not to make the outermost corrugated rib strips, which according to the idea of the present invention are intended to give off heat to the side parts, from a material with reduced thermal conductivity. In practice, the heat-transferring ability even of a corrugated rib strip provided with low thermal conductivity is sufficient to give off heat to the side parts.

Other objects, advantages and novel features of the present invention will become apparent from the following detailed description of the invention when considered in conjunction with the accompanying drawings.

BRIEF DESCRIPTION OF THE DRAWINGS

FIG. 3 is a section through the fin-tube block of FIG. 1 viewed in the direction of section line III—III;

FIG. 4 is an enlarged view of detail IV in FIG. 3;

FIG. 5 is a view of an outer corrugated rib strip abutting the side parts, looking in the direction of arrow V in FIG. 3; and FIG. 6 is a top view of the corrugated rib strip in FIG. 5.

DETAILED DESCRIPTION OF THE DRAWINGS

Figure 1:
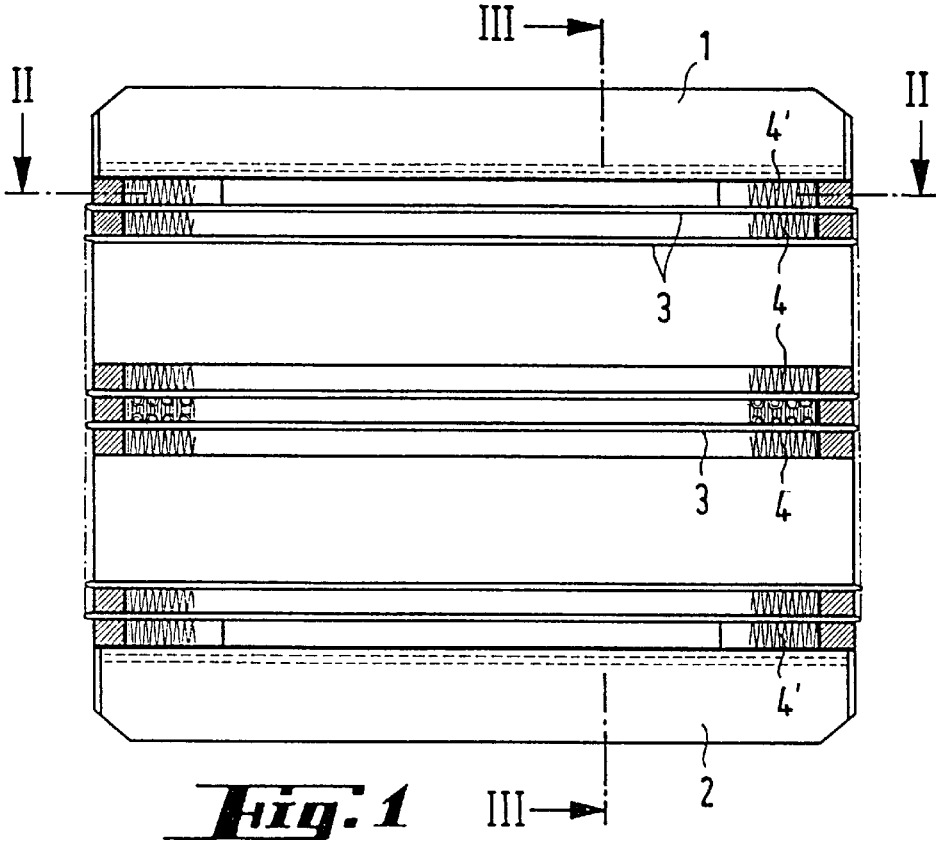
FIG. 1 is a schematic diagram of a section through the fin-tube block for a charge air cooler constructed according to preferred embodiments of the invention, without showing water tanks.
Figure 2:
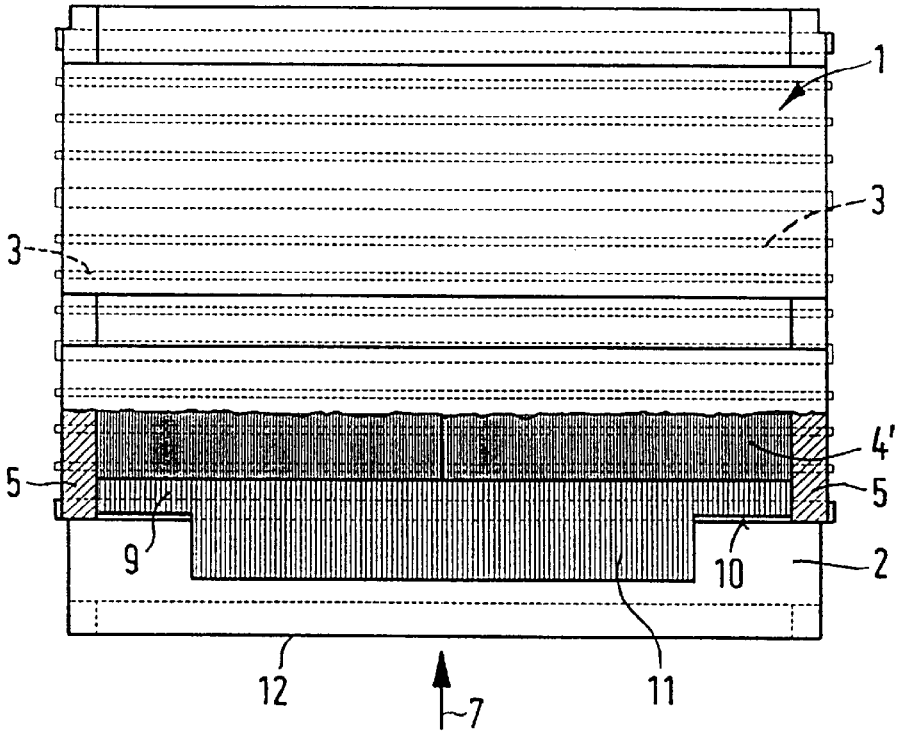
FIG. 2 is a partial section through the fin-tube block of FIG. 1 viewed in the direction of line II—II.

FIGS. 1 to 3 show a fin-tube block for a charge air cooler, including two side parts 1 and 2 to be joined later to water tanks, as well as tubes 3 running parallel to these side parts, and of fin-shaped corrugated ribs 4 located between tubes 3. Between the respective outermost tubes 3 and side parts 1 and 2, corrugated ribs 4' are likewise provided that can be seen in FIG. 2 in the area where the upper side part is shown cut off. It is also evident from FIG. 2 that the ends of tubes 3 are each secured in tube sheet 5 and are later closed off by the water tanks.

FIGS. 2 and 3 clearly show that the outermost corrugated ribs 4' abutting side parts 1 and 2, which form a layer that abuts the side parts, like corrugated ribs 4 that form the additional layers, are formed in intake area 6 for the charge air flowing in the direction of arrow 7 by inserted corrugated rib strips 8 and 9 that extend from intake edge 10 of the fin-tube block up to a depth a. These corrugated rib strips 8 and 9 can be made of a material that has a lower thermal conductivity than the other corrugated ribs 4 and 4'. Such an arrangement is used in the first impact area of the charge air on the fin-tube block, in other words at the location where the charge air temperature can reach 235° C., to reduce the heat given off to the tubes traversed by the coolant in order to prevent the coolant from boiling for example.

FIGS. 2 and 3 to 6 show that corrugated rib strip 9 located in front of corrugated rib layer 4' has a central area 11 that projects beyond intake edge 10 for the charge air in the direction of leading edges 12 of side parts 1 and 2. In the illustrated embodiment, the central area 11 projects by approximately half the length b by which this leading edge 12 is located opposite flow direction 7 of the charge air in front of intake edge 10 of the fin-tube block. Since the outermost corrugated rib layer 4' and also corrugated rib strip 9 with its forwardly projecting section 11 abut side parts 1 and 2 and are preferably soldered there, good thermal contact exists between corrugated rib strip 9 and its projecting section 11, and the side parts. Section 11 has a width less than that of the part of corrugated rib strip 9 located behind it in the flow direction. On both sides of section 11 there are recesses 13 that engage the fin-tube block in the areas of side parts 1 and 2 where a welded seam must be provided to join the side parts to the water tanks, which would result in damage to corrugated rib strip 9 if section 13 of said strip were brought up to the edge.

The entering hot charge air which also contacts section 11 creates a situation in which side parts 1 and 2 are heated more rapidly in the area located in front of intake edge 10 of the fin-tube block than would be the case without corrugated rib strip 9. Side parts 1 and 2 therefore heat up analogously to corrugated ribs 4, 4' and also expand analogously to the fin-tube block, depending on the charge air temperature. The thermal stresses that occur in the intake area of the charge air can thus be reduced.

It is contemplated according to certain preferred embodiments to make corrugated rib strips 9, as described initially above, from a material with a thermal conductivity less than that of the other corrugated ribs 4, 4'. However, it is also contemplated for them to have the same thermal conductivity as all of the other corrugated ribs so that especially good heat transfer to side parts 1 and 2 can occur in the intake area.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. Fin-tube block for a charge air cooler heat exchanger comprising:

a plurality of tubes extending parallel to one another and fin-shaped corrugated ribs located between said tubes, said block being placed in a fixed frame composed of two water tanks that surround open tube ends and of two side parts connecting said tanks, wherein outermost ones of said corrugated ribs adjoining the side parts are extended beyond a plane defined by outer edges of the other corrugated ribs toward an intake edge of charge air entering the fin-tube block.

2. Fin-tube block according to claim 1, wherein the outermost corrugated ribs in an intake area are each extended by a corrugated rib strip located toward a leading edge of the side parts which define an intake cross-section.

3. Fin-tube block according to claim 2, wherein the corrugated rib strip has a variable depth in a flow direction of the air and is provided with recesses in a vicinity of the water tanks.

4. Fin-tube block according to claim 2, wherein the outermost corrugated rib strip, in an area that extends over an entire width, extends up to a depth beyond an adjacent corrugated ribs, and consists of a material with a thermal conductivity less than that of the other corrugated ribs.

5. Fin-tube block according to claim 4, wherein the outermost corrugated rib strip is made of a material with a thermal conductivity less than that of the other corrugated ribs.

6. Fin-tube block for a charge air cooler heat exchanger, comprising:

a plurality of tubes extending parallel to one another, and fin shaped corrugated ribs disposed between layers of said tubes, said fin-tube block disposed in a fixed frame composed of two liquid tanks which open to respective open ends of said tubes and of two side parts connecting said tanks, and wherein outermost ones of said corrugated ribs adjoining the side parts are extended beyond a plane defined by outer edges of the other corrugated ribs toward a charging gas intake end of the fin tube block, thereby assuring rapid temperature transfer from the charging gas to the side parts with consequent compensation for expansion movements of the fin-tube block in the charging gas intake area.

7. Fin tube block according to claim 6, wherein a respective corrugated rib strip with different lengths in a direction of flow of the charging gas is provided adjacent said side parts, said corrugated rib strips including shorter sections defining recesses in a vicinity of the liquid tanks.

8. A method of making a fin-tube block for a charge air cooler heat exchanger, comprising:

forming layers of tubes extending parallel to one another, forming fin shaped corrugated rib layers, and alternatively stacking the layers of tubes and corrugated rib layers to form a fin tube block and disposing in a fixed frame composed of two liquid tanks which open to respective open ends of said tubes and of two side parts connecting said tanks, wherein outermost ones of said corrugated ribs adjoining the side parts are extended beyond a plane defined by outer edges of the other corrugated ribs toward a charging gas intake end of the fin tube block, thereby assuring rapid temperature transfer from the charging gas to the side parts with consequent compensation for expansion movements of the fin-tube block in the charging gas intake area.

9. A method according to claim 8, wherein a respective corrugated rib strip with different lengths in a direction of flow of the charging gas is provided adjacent said side parts, said corrugated rib strips including shorter sections defining recesses in a vicinity of the liquid tanks.

10. A method according to claim 8, wherein corrugated rib portions adjacent said side parts and at the charging gas intake end have different thermal expansion characteristics than other rib portions of said corrugated rib sections.

* * * * *